US006397522B1

(12) United States Patent
Nussbaum

(10) Patent No.: US 6,397,522 B1
(45) Date of Patent: Jun. 4, 2002

(54) SLIDING-ROTATING LEAF SYSTEM

(75) Inventor: Bjoern Nussbaum, Osnabrueck (DE)

(73) Assignee: Solarlux Aluminium Systeme GmbH, Bissendorf (DE)

( * ) Notice: Subject to any disclaimer, the term of this patent is extended or adjusted under 35 U.S.C. 154(b) by 0 days.

(21) Appl. No.: 09/664,928

(22) Filed: Sep. 19, 2000

(30) Foreign Application Priority Data

Sep. 20, 1999 (DE) ..... 199 45 035
Jan. 20, 2000 (DE) ..... 100 02 214

(51) Int. Cl.[7] ..... E05D 15/26
(52) U.S. Cl. ..... 49/127; 49/130
(58) Field of Search ..... 49/126, 127, 128, 49/129, 130, 409, 410

(56) References Cited

U.S. PATENT DOCUMENTS

| | | | | |
|---|---|---|---|---|
| 1,934,299 A | | 11/1933 | Fairhurst | |
| 2,574,312 A | | 11/1951 | Rosario | |
| 3,027,606 A | * | 4/1962 | Nicklas | |
| 3,303,612 A | * | 2/1967 | Baker | |
| 5,749,172 A | * | 5/1998 | Isopahkala | 49/127 |
| 6,065,247 A | * | 5/2000 | Sundvall | 49/258 |
| 6,301,833 B1 | * | 10/2001 | Airikkala | 49/409 |

FOREIGN PATENT DOCUMENTS

| | | |
|---|---|---|
| DE | 333128 | 2/1921 |
| EP | 0610263 | 3/1997 |
| WO | 97/39215 | 10/1997 |
| WO | 98/46651 | 10/1998 |

* cited by examiner

*Primary Examiner*—Curtis Cohen
(74) *Attorney, Agent, or Firm*—Jordan and Hamburg LLP

(57) ABSTRACT

A sliding-rotating leaf system especially for enclosing a balcony with glass has several leaves (1, 1'), which have an area element (2) and can be swiveled about an axis of rotation (4) and of which at least one additionally is constructed movably as a sliding-rotating leaf (1'). The sliding-rotating leaves (1') are mounted movably in guide rails (7) at the rollers (5, 5'). Coupling elements (9) on the rail side, traversable by the sliding-rotating leaves (1'), are connected with the guide rail (7) and can be bought into engagement with at least one coupling piece (8) on the leaf side disposed at the axis of rotation (4) of the sliding-rotating leaf (1') and lock the sliding-rotating leaf (1') to prevent shifting when it is swiveled. The coupling piece (8), in a section at right angles to the axis of rotation (4), has the shape of a circle having a recess (14) at one side of the area element (2), as a result of which the extent of the coupling piece (8), from the axis of rotation (4) transversely to the area element (2) in the direction of the recess (14), is less than on the opposite side of the axis of rotation (4) and than on either side along the area element (2).

26 Claims, 2 Drawing Sheets

SLIDING-ROTATING LEAF SYSTEM

The invention relates to a sliding-rotating leaf system especially for enclosing a balcony with glass, but also for movable window elements, door elements, gate elements, room dividers and roof or shading elements, as defined in the introductory portion of claim 1.

Such systems are used when a separation consists of at least two area elements, of which at least one area element. is to be constructed to be not only pivotable, but also movable, so that the area so equipped can be opened largely completely and preferably to one side. These systems therefore have a plurality of leaves, which accommodate area elements and of which the two outer ones, as a rule, are constructed are constructed strictly as rotating leaves, which can be swiveled about a stationary axis of rotation, which cannot be shifted, whereas the inner ones are sliding-rotating leaves, which are mounted not only pivotably, but also movably at one side in a guide rail. So that the sliding-rotating leaves cannot slide of the guide rail unintentionally during the swiveling, it is important to lock the sliding-rotating leaves, so that they cannot shift during the swiveling and in the swiveled state.

Different systems are already known, for which the sliding-rotating leaves and the guide rail contain mutually assigned coupling parts in order to ensure the locking during the swiveling. The coupling parts also serve to take up the tilting moments acting on the sliding-rotating leaves. In the EP 0 610 263 B1, a system is disclosed, for which the coupling part of the sliding-rotating leaves is formed by a chisel-shaped constriction of the axis or rotation and the coupling part of the guide rail is formed by a round recess. Admittedly, the locking function is guaranteed by these means. However, a sliding-rotating leaf can be shifted partly out beyond the intended coupling part of the guide rail into a position, in which swiveling can no longer take place. When a sliding-rotating leaf therefore was pushed to the side up to the stop, it is necessary to retract this always somewhat until an accurately fitting engagement of the coupling parts is achieved. This adjustment slows down the handling of the previously known system and makes it more difficult.

It is therefore the object of the invention to indicate a generic sliding-rotating leaf system, which has good stability and is distinguished by the ease of handling, which minimizes the possibilities for faulty operations.

Pursuant to the invention, this objective is accomplished by a siding-rotating leaf system with the distinguishing features of claim 1.

Figure 1:
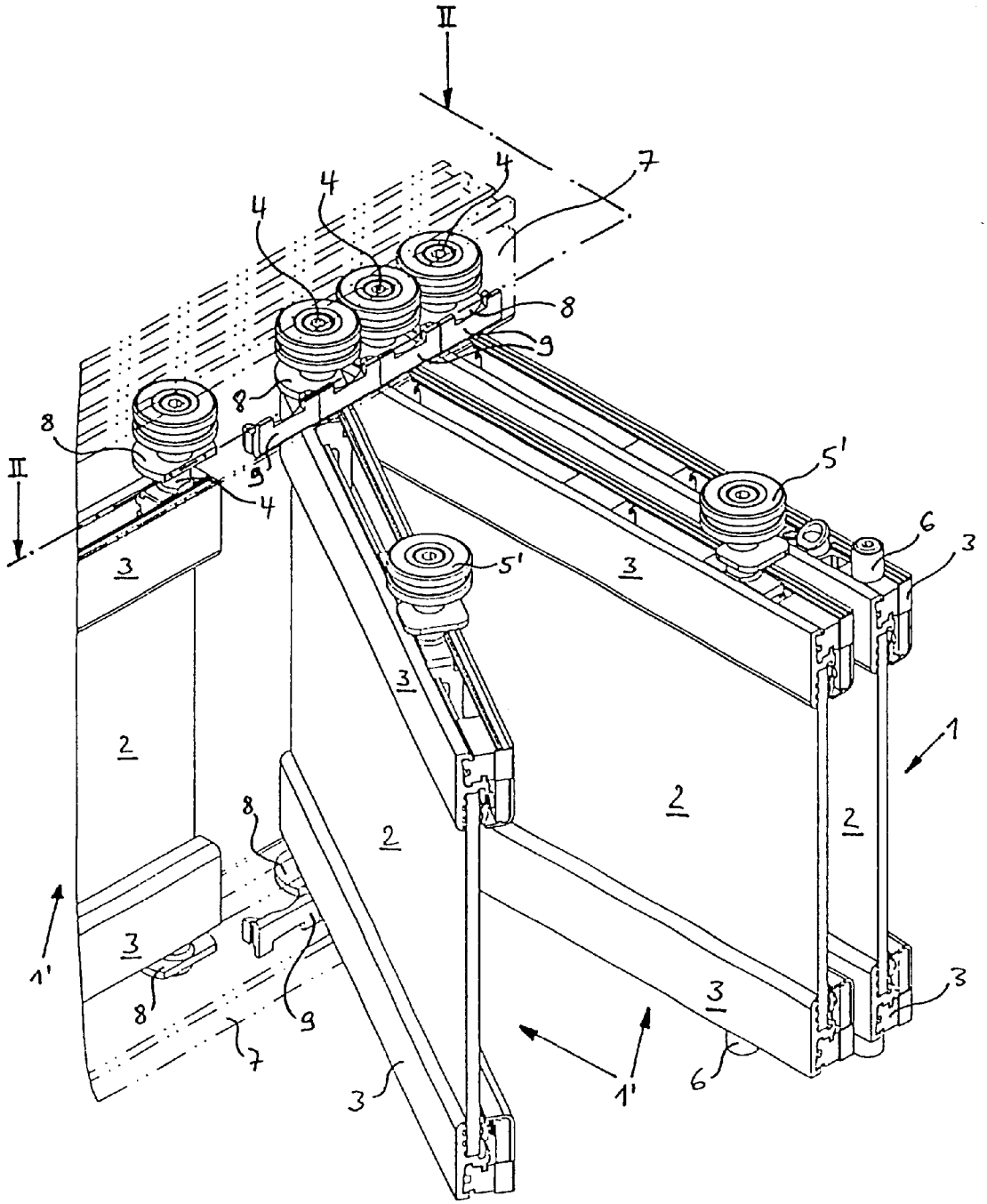

Due to the construction of the coupling piece, assigned to the sliding-rotating leaf, in a circular shape in cross section provided on one side with a recess, the side of the coupling piece opposite to the recess can serve as a stop for a coupling piece of a subsequent sliding-rotating leaf, when the preceding sliding-rotating leaf is already swiveled in its coupling element. A subsequent sliding-rotating leaf can then be pushed towards the preceding one only until it has precisely reached the subsequent coupling element. A cumbersome adjustment of the sliding-rotating leaf becomes unnecessary, since the latter is always pushed precisely, laterally up to the stop and can be swiveled in the position attained. Therefore, when the sliding-rotating leaf system is opened to the maximum extent, the sliding-rotating leaves automatically attain the correct swiveling position. Tilting or jamming is avoided Further advantages and details arise out of the example of the inventive system, which is described below and shown in the drawings, in which FIG. 1 shows a three-dimensional representation of an inventive sliding-rotating leaf system (partly), FIG. 2 shows a section along the plane II—II of FIG. 1 in a different position of the sliding-rotating leaf and FIG. 3 shows the object of FIG. 2 in the position of the sliding-rotating leaf of FIG. 1.

The sliding-rotating leaf system, shown as example, has eight leaves 1, 1', of which the inner six are constructed as sliding-rotating leaves 1' and the two outer ones are constricted strictly as rotating leaves 1. Since the system is constructed symmetrically, only the right side of the displaceable sliding-rotating leaf 1' and the right rotating leaf 1 are shown for the sake of simplicity. Each leaf 1, 1' has an area element 2, which is held in frame profiles 3 and is connected over these with axes of rotation 4 and rollers 5. The outer rotating leaf 1 has only one roller 5 and one guide pin 6 at its upper side. On the other hand, each of the movable sliding-rotating leaves 1' has two rollers 5, 5'at the frame profile 3 on the upper side. In every position of the sliding-rotating leaf 1', the roller 5, disposed at the end of the frame profile 3, remains within a guide rail 7, which is only indicated in FIG. 1 by lines of dots and dashes, while the other rollers 5' during the swiveling of the sliding-rotating leaves 1', emerge from an opening of the guide rail 7, which is not shown. In order to lock the sliding-rotating leaf 1' so that it is not shifted during the swiveling motion, coupling pieces 8 are disposed at the axes of rotation 4 of the sliding-rotating leaf 1' and, during the swiveling, engage complementary coupling elements 9 fastened in the guide rail 7. Preferably, the coupling pieces 8 are constructed disk-shaped, as shown, since a compact construction is achieved in this manner. They can be constructed, preferably, in one piece with the axis of rotation 4.

Figure 2:
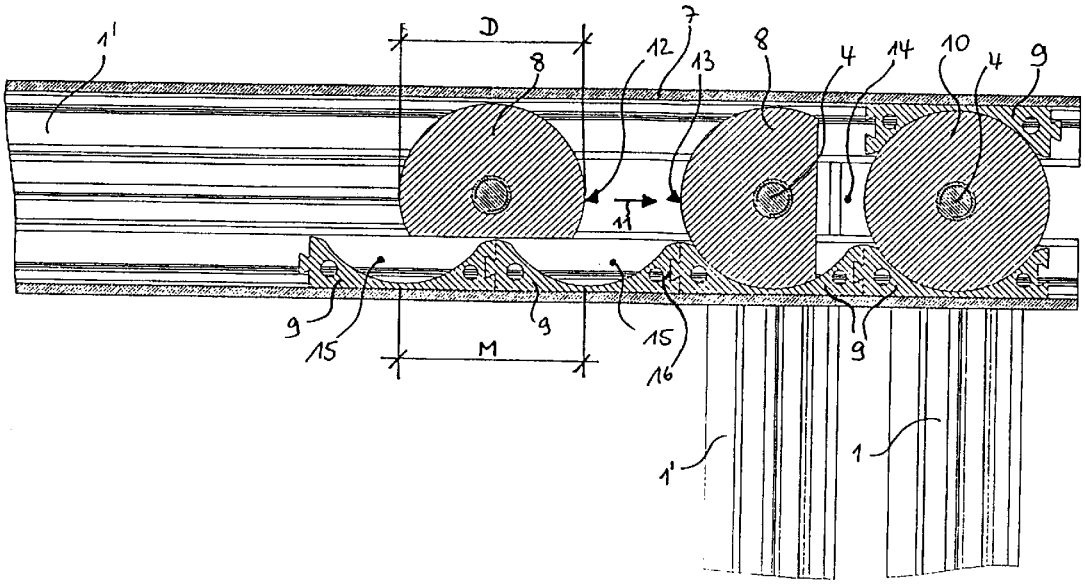
Figure 3:
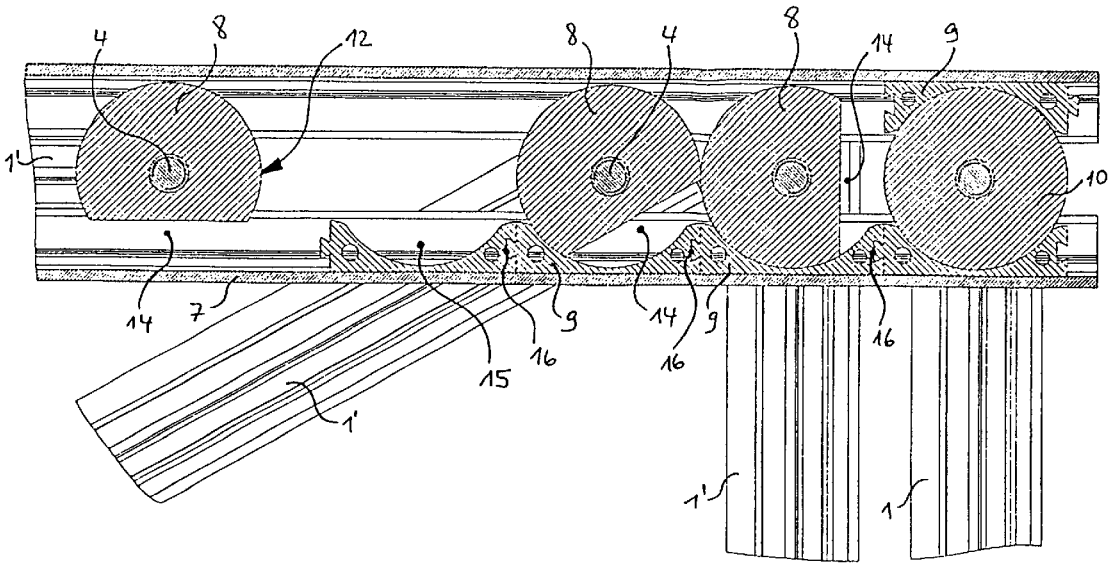

The exact shape and function of the coupling pieces 8 and coupling elements 9 are shown in greater detail in FIGS. 2 and 3. It can be seen there that the rotating leaf 1 has a circular pivot bearing disk 10 and is mounted with this in two oppositely disposed coupling elements 9 of the guide rail 7 so that it can be rotated but not shifted. The rotating leaf 1 is already swiveled up, as is also the adjacent sliding-rotating leaf 1' which, with its coupling piece 8, engages the next coupling element 9. In FIG. 2, the next sliding-rotating leaf 1' is still not yet swiveled in the, plane stretching between the two guide rails 7 and is shifted laterally in the direction of arrow 11, until the side 12 of its coupling piece 8 comes up against the back side 13 of the preceding coupling piece 8. This serves as a stop for the subsequent coupling piece 8. In order to be able to fulfill this function, the coupling pieces 8, in the section at right angles to the axis of rotation 4, have a circular shape reduced by a recess 14. This recess 14 enables the sliding-rotating leaf 1' to be shifted past the coupling elements 9, as long as the sliding-rotating leaf 1' has not yet been swiveled. Preferably, the recess 14 reduces the coupling piece 8, as shown, by a segment in the shape of a circular cap, since by these means a shifting of the coupling piece 8 within the guide rail 7 is possible, without weakening the coupling piece 8 unnecessarily.

A balanced mounting and good support of the sliding-rotating leaf 1' is achieved particularly if the axis of rotation 4, as shown, is concentric with the center of the circle of the cross-section of the coupling piece 8. In the case of such a development, it is sufficient if the coupling elements 9 for the sliding-rotating leaf 1' are disposed only along one side of the guide rail. If the coupling elements 9 do not have to span both sides of the guide rail 7 in one piece, they can be disposed at any convenient height within the guide the 7.

Correspondingly, the coupling pieces 8 also do not have to be disposed above the rollers 5, as they do in the case of the known systems, but may be located, as in the case of the embodiment shown, between the rollers 5 and the area element 2, so that the system can be constructed in a very space-saving manner.

Preferably, the coupling pieces 8 and the coupling elements 9 are matched to one another so that the diameter D of the circle of the coupling cross-section corresponds to the distance M of the respective center of two; adjacent elements 9 along of the guide rail 7. Accordingly, the sliding-rotating leaves 1' are in a position, level with a coupling element 9 and permitting a swiveling motion, precisely when their coupling piece 8 comes into contact with the preceding coupling piece 8.

Preferably, the coupling elements 9 are shaped so that they also have recesses 15 in the shape of a circular cap, corresponding to the recesses 14 of the coupling pieces 8. As a result, during the swiveling of the sliding-rotating leaf 1', the whole surface of the coupling pieces 8 lies in the region of the coupling elements 9 at the surface, formed by the recess 15, so that the forces, which are to be absorbed, are distributed uniformly.

If the surface elements 2 are disposed vertically, as in the embodiment shown, it is also possible, depending on the configuration of the guide rail 7 and the rollers 5, to guide the leaves 1,1' only at the upper side in a guide rail 7. However, to improve the stability and the absorption and distribution of tilting moments when the leaves 1,1' are swiveled out, it is advantageous to guide the leaves 1,1' at both ends, that is, in the case of the embodiment shown, at the top and at the bottom in guide rails 7. This is usually also required when the surface elements are disposed horizontally or obliquely and not vertically. Such an embodiment is particularly stable and secured against tilting or jamming if both guide rails 7, as shown, have coupling elements 9, which are shaped pursuant to the invention and into which the corresponding coupling pieces 8 engage at both ends of the leaves 1,1'.

Admittedly, the embodiment shown has precisely three coupling elements 9 for the three sliding-rotating leaves 1' on each side of the guide rail 7. However, it is equally possible to dispose more coupling elements 9 in the guide rail than there are sliding-rotating leaves 1'. This enables the sliding-rotating leave 1' to swivel not only at the outer end of the guide rail 7, but also at other positions, at which the remaining coupling elements 9 are located. For the greatest possible flexibility, the guide rail 7 can therefore be equipped throughout with coupling elements 9.

The joining together and accurately fitting alignment of the coupling elements 9 and also their installation is facilitated, if the these have mutual possibilities for connection, which are constructed particularly for positive connections and/or for frictional connections. The coupling elements of the example interlock with a dovetail-shaped tongue and groove connection 16.

The construction of the inventive leaf system is simple, and the system is easy to install, exceptionally stable and user friendly.

What is claimed is:

1. A sliding rotating leaf system comprising:

a guide rail;

a plurality of area elements each having at least one roller movable on said guide rail, each of said area elements being movable on said guide rail between a folded position and an unfolded position;

a plurality of coupling elements arranged on said guide rail; and a coupling piece arranged on each of said area elements, a largest diametral dimension of a circular segment of each of said coupling pieces being equal to a distance between centers of adjacent one of said coupling elements whereby each of said coupling pieces serves as a stop for positioning said coupling piece of an adjacent one of said area elements in alignment with a respective one of said coupling elements;

said coupling piece of each of said area elements engaging a respective one of said coupling elements on said guide rail when said area element is in said folded position to prevent translatory movement of said coupling piece relative to said respective coupling element while permitting rotary movement of said coupling piece relative to said respective coupling element;

said coupling piece of each of said area elements rotating relative to said respective coupling element upon initiating movement of said area element from its folded position to thereby disengage said coupling piece from said respective coupling element to enable translatory movement of said area element toward said unfolded position as said at least one roller of said area element rolls on said guide rail.

2. A sliding rotating leaf system according to claim 1 wherein each of said coupling pieces has a circular outer portion and a recessed outer portion, said circular outer portion having a center, said circular outer portion being radially spaced from said center a first radial distance, said recessed outer portion being radially spaced from said center a second radial distance which is less than said first radial distance.

3. A sliding rotating leaf system according to claim 2 wherein said circular outer portion subtends an angle of greater than 180 degrees.

4. A sliding rotating leaf system according to claim 2 wherein said recessed portion is generally flat.

5. A sliding rotating leaf system according to claim 2 wherein said at least one roller has an axis of rotation which is coincident with said center of said circular outer portion of said coupling piece.

6. A sliding rotating leaf system according to claim 1 wherein each of said coupling pieces has a circular outer portion and a generally flat chordal portion.

7. A sliding rotating leaf system according to claim 1 wherein each of said coupling elements has a circular inner portion which subtends an angle of less than 180 degrees.

8. A sliding rotating leaf system according to claim 1 wherein said at least one roller is axially spaced from said area element, said coupling piece being arranged in the space between said at least one roller and said area element.

9. A sliding rotating leaf system according to claim 1 wherein each of said coupling pieces includes a partial convex surface and said coupling element includes a partial concave surface, said convex surface being disposed in said concave surface when said area element is in said folded position, said convex surface being displaced from said concave surface to effect said disengagement of said coupling piece from said coupling element.

10. A sliding rotating leaf system according to claim 9 wherein said concave surface is a partial inner cylindrical surface having a first axis and said convex surface is a partial outer cylindrical surface having a second axis, said first axis being coincident with said second axis when said area element is in said folded position.

11. A sliding rotating leaf system according to claim 10 wherein said partial inner cylindrical surface and said partial outer cylindrical surface have substantially equal radius of curvatures.

12. A sliding rotating leaf system according to claim 10 wherein said area element is pivotal about a pivot axis coincident with said second axis of said partial outer cylindrical surface.

13. A sliding rotating leaf system according to claim 12 wherein said area element has an intermediate position intermediate said folded and unfolded position, said area element being movable from said unfolded position to said intermediate position by pivoting said area element about said pivot axis, said area element being movable from said intermediate position to said unfolded position by effecting translatory movement of the area element along said guide rail.

14. A sliding rotating leaf system according to claim 13 wherein said coupling piece and said respective coupling element are arranged to cooperate to disable said translatory movement of said area element when said area element is being pivoted from said unfolded position to said intermediate position.

15. A sliding rotating leaf system according to claim 14 wherein said guide rail is an elongate guide rail and said area element has a flat portion, said flat portion of said area element being substantially perpendicular to the elongate extent of said guide rail when said area element is in the folded position, said flat portion of said area element being substantially parallel to the elongate extent of said guide rail when said area element is in the intermediate position.

16. A sliding rotating leaf system according to claim 1 wherein said coupling piece is fixed to said area element.

17. A sliding rotating leaf system comprising:

a guide rail;

a plurality of area elements each having at least one roller movable on said guide rail;

at least some of said area elements being movable on said guide rail between folded and unfolded positions;

a plurality of coupling elements arranged on said guide rail;

a coupling piece arranged on at least some of said area elements, a largest diametral dimension of a circular segment of each of said coupling pieces being equal to a distance between centers of adjacent one of said coupling elements whereby each of said coupling pieces serves as a stop for positioning said coupling piece of an adjacent one of said area elements in alignment with a respective one of said coupling elements;

each of said coupling pieces engaging a respective one of said coupling elements on said guide rail when said area element is in said folded position to prevent translators movement of said coupling piece relative to said respective coupling clement while permitting rotary movement of said coupling piece relative to said respective coupling element;

said coupling piece of each of said area elements rotating relative to said respective coupling element upon initiating movement of said area element from its folded position to thereby disengage said coupling piece from said respective coupling element to enable translatory movement of said area element toward said unfolded position as said at least one roller rolls on said guide rail.

18. A sliding rotating leaf system according to claim 17 wherein each of said coupling pieces has a partial outer cylindrical surface having a first axis and each of said coupling elements has a partial inner cylindrical surface having a second axis, the first axis being coincident with the second axis when said area element is in the folded position.

19. A sliding rotating leaf system according to claim 18 wherein the partial outer cylindrical surface of said coupling piece is spaced from the first axis a first radial distance which is one-half of the largest diametral dimension of said coupling piece.

20. A sliding rotating leaf system according to claim 18 wherein outer cylindrical surfaces of said coupling pieces are juxtaposed to one another when said area elements are in said folded position.

21. A sliding rotating leaf system according to claim 20 wherein juxtaposed outer cylindrical surfaces of said coupling pieces are substantially in contact with one another when said area elements are in said folded position.

22. A sliding rotating leaf system according to claim 17 further including connections connecting said coupling elements to one another on said guide rail.

23. A sliding rotating leaf system comprising:

a guide rail;

a plurality of area elements each having a roller movable on said guide rail, each of said area elements being movable on said guide rail between a folded position and an unfolded position;

retaining means arranged on said guide rail and defining a plurality of arcuate recesses; and coupling pieces connected to each of said area elements, a largest diametral dimension of a circular segment of each of said coupling pieces being equal to a distance between centers of adjacent one of said recesses of said retaining means such that each of said coupling pieces serves as a stop for positioning said coupling piece of an adjacent one of said area elements in alignment with a respective one of said recesses;

said coupling pieces of each of said area elements engaging a respective one of said recesses of said retaining means on said guide rail when said area element is in said folded position to prevent longitudinal movement of said coupling piece relative to said retaining means while permitting rotary movement of said coupling piece relative to said respective recess;

said coupling piece of each of said area elements rotating relative to said respective recess upon initiating movement of said area element from its folded position to thereby disengage said coupling piece from said retaining means to enable longitudinal movement of said area element toward said unfolded position as said rollers of said area element rolls on said guide rail.

24. The sliding-rotating leaf system of claim 23, wherein said retaining means comprise a plurality of individual coupling elements, each of said coupling elements defining a single one of said recesses.

25. The sliding-rotating leaf system of claim 23, wherein said retaining means further coupling means for coupling said coupling elements together.

26. The sliding-rotating leaf system of claim 25, wherein said coupling means comprise a tongue arranged on one side of each of said coupling elements and a corresponding groove arranged on an opposite side of each of said coupling elements.

* * * * *